United States Patent [19]

Cohen

[11] 4,196,813

[45] Apr. 8, 1980

[54] HANGER FOR DISPLAYING TROUSERS

[75] Inventor: Maurice Cohen, Miami, Fla.

[73] Assignee: Sel-O-Rak Corporation of America, Miami, Fla.

[21] Appl. No.: 917,391

[22] Filed: Jun. 19, 1978

[51] Int. Cl.[2] ..... A47F 7/19

[52] U.S. Cl. ..... 211/168; 223/95

[58] Field of Search ..... 211/168, 165, 172, 205, 211/105.4, 96; 223/95

[56] References Cited

U.S. PATENT DOCUMENTS

| | | | |
|---|---|---|---|
| 1,386,015 | 8/1921 | Montgomery | 223/95 X |
| 1,670,938 | 5/1928 | Printz et al. | 223/95 |
| 1,879,679 | 9/1932 | Gover | 211/96 |
| 2,690,843 | 10/1954 | Ament | 211/165 X |
| 2,895,621 | 7/1959 | Cohen | 211/165 |
| 2,998,904 | 9/1961 | Bellg | 223/95 |

FOREIGN PATENT DOCUMENTS

| | | | |
|---|---|---|---|
| 1485079 | 1/1970 | Fed. Rep. of Germany | 211/168 |
| 663671 | 12/1951 | United Kingdom | 211/168 |
| 764722 | 1/1957 | United Kingdom | 223/95 |
| 791521 | 3/1958 | United Kingdom | 211/168 |

*Primary Examiner*—Ramon S. Britts
*Assistant Examiner*—Robert W. Gibson, Jr.
*Attorney, Agent, or Firm*—Salter & Michaelson

[57] ABSTRACT

A hanger for displaying trousers on a display rack and including an elongated arm on the outer end of which a sleeve is mounted, the trousers being suspended by the waist from the arm and the sleeve being longitudinally adjusted relative to the arm to tension the waist portion of the trousers for locating the trousers in an extended and suspended display position.

6 Claims, 5 Drawing Figures

HANGER FOR DISPLAYING TROUSERS

BACKGROUND OF THE INVENTION

The present invention relates to a hanger for displaying trousers on a display rack, and more particularly relates to a hanger having a waist grip that tensions the waist portion of trousers mounted thereon for locating the trousers in an extended display position.

Garment display racks for displaying trousers and the like are well known and heretofore various kinds of trouser display racks have been employed in retail haberdashery establishments. One kind of trouser display rack is generally defined as an island unit that is self-contained and is usually located in an interior area of the establishment and away from the walls thereof. Such units are usually circular in construction and also rotate so as to provide convenient access to the customer of all the garments as displayed on the rack. Examples of such racks are illustrated in patents D-168,143, Re-24,427 and U.S. Pat. No. 2,960,239.

In the aforesaid patents, the garments or trousers are held in place by locating trousers over a horizonatal bar of a hanger that is pivotally mounted on a central column of the display rack. This form of island display rack has been found to be satisfactory, particularly in those establishments where the customer or clerk must have convenient access to the garments as contained on the individual hangers and must remove the trousers or garments for inspection and handling. However, in some instances, it is desirable to suspend the garment from a hanger as mounted on a island rack for the full length thereof and in this instance, spring clips or the like that are attached to the waistband have been utilized heretofore as illustrated in U.S. Pat. No. 3,239,902.

In all of the garment racks and display hangers as used therewith as illustrated in the above-referred to patents, the garments are removable from the hangers for inspection and handling as desired. Although this kind of garment display is somewhat usual in the manner of displaying trousers, on occasion it is also desirable to suspend the trousers from the waist and to prevent the inadvertent removal thereof from the rack on which the trousers are displayed.

SUMMARY OF THE INVENTION

The present invention relates to a hanger for displaying trousers on an island display rack and includes an elongated arm having an inner and outer end portion. The inner end portion of the arm is mounted for pivotal movement on the rack and locates the arm in cantilevered relation thereon. An adjustment member in the form of a sleeve is mounted on the outer end portion of the arm, and the sleeve is longitudinally adjustable relative to the arm and also engages the waist portion of the trousers. The trousers further are mounted on an inner portion of the arm and are gripped along the waist by the inner end portion and the sleeve. By adjusting the sleeve outwardly relative to the arm, the waist portion of the trousers is gripped in tensioned relation, thereby locating the trousers in an extended and suspended position for display. Further, the trousers are locked on the hanger and cannot be removed therefrom except by release of the sleeve from the adjusted position thereof.

Accordingly, it is an object of the invention to provide a rack for displaying trousers thereon that includes a display hanger from which the trousers are suspended in tensioned relation at the waistband thereof.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
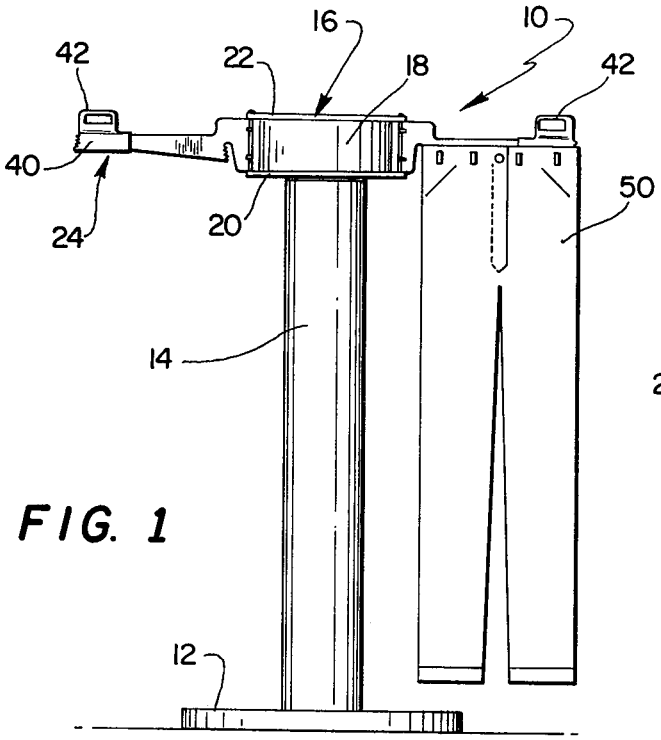
FIG. 1 is a front elevational view of a display rack showing the hanger embodied in the present invention with a pair of trousers mounted in an extended and suspended display position thereof.
Figure 2:
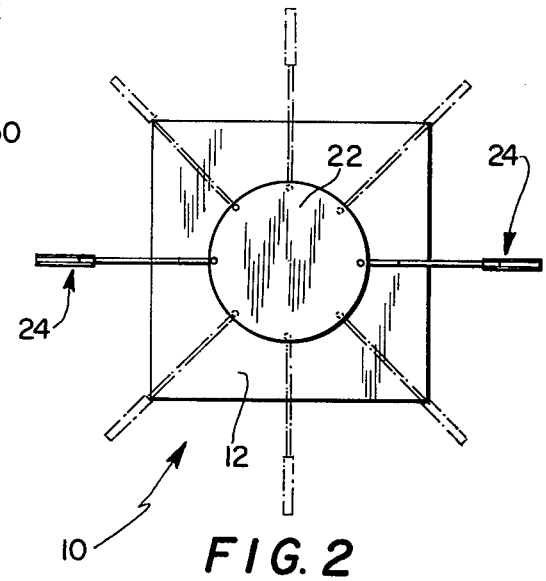
FIG. 2 is a top plan view of the display rack.

Referring now to the drawing and particularly to FIG. 1, an island display rack for displaying garments such as trousers thereon is illustrated and is generally indicated at 10. The display rack 10 includes a base 12 that is preferably formed in a square configuration, although it is understood that the shape of the base may be circular or of any other geometric configuration that is suitable for the design of the rack. Mounted on the base 12 is a vertical column 14 in which an interior shaft or spindle (not shown) is located. Located at the uppermost end of the column 14 and suitably mounted on the interior shaft is a drum assembly generally indicated at 16, the drum assembly including a drum 18 that is mounted between a lower disc 20 and an upper disc 22. The drum assembly 16 is preferably rotatable relative to the column 14 and if desired the drum assembly may be racheted for intermitent rotary movement as required. The interior construction of the drum assembly 16 as mounted on the shaft that is enclosed within the column 14, is not specifically illustrated, and may take any conventional form as is well known in the art.

Figure 3:
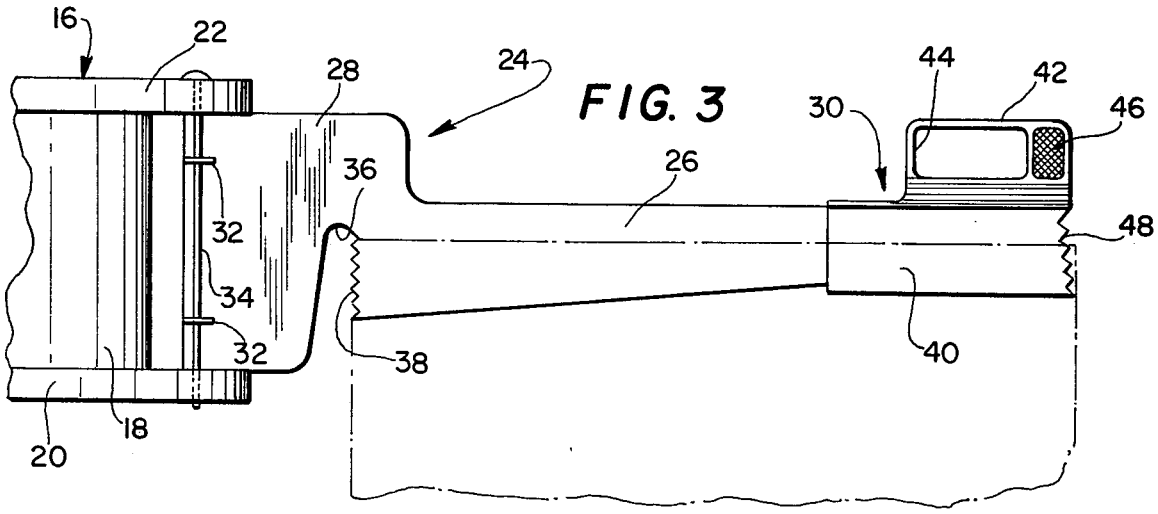
FIG. 3 is an enlarged elevational view of the hanger.

Mounted for pivotal movement on the drum assembly 16 are a plurality of garment hangers, each of which is generally indicated at 24. Referring now to FIG. 3, one of the garment hangers is illustrated, and as shown includes a relatively thin bar-like elongated arm 26 that is formed with an enlarged rear end portion 28 and a forward portion on which a sleeve generally indicated at 30 is mounted. The rear end portion 28 of the arm has a vertical dimension that enables it to be received between the discs 20 and 22 of the drum assembly 16, and includes clips 32 through which a pin 34 extends, the pin 34 being received within appropriate openings as formed within the discs 20 and 22, thereby providing for pivotal movement of the hanger 24 relative to the drum assembly 16.

As shown in FIG. 3, the vertical dimension of the arm 26 is reduced relative to the vertical dimension of the rear end portion 28 thereof, a slot 36 being formed in the rear end portion 28. The forward portion of the slot 36 is formed with a serrated edge or shoulder portion 38, the serrated edge 38 cooperating with a similar serrated portion, to be described, of the sleeve 30 to positively receive the waist portion of a pair of trousers in extended relation thereon.

Figure 5:
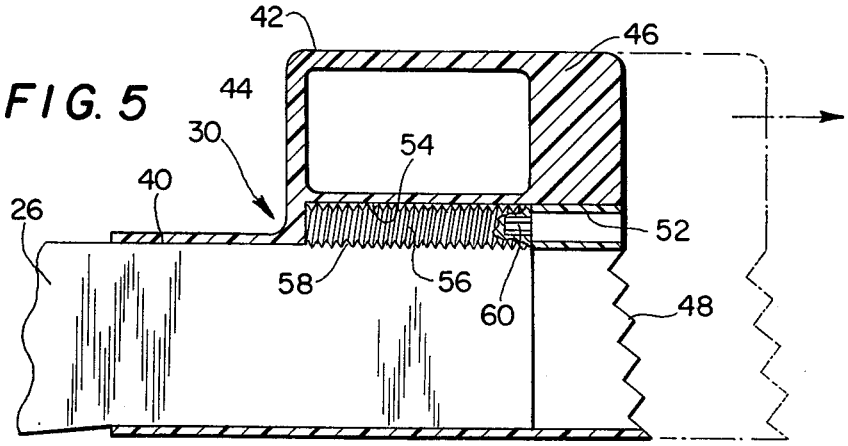
FIG. 5 is a sectional view taken along line 5—5 in FIG. 4.
Figure 4:
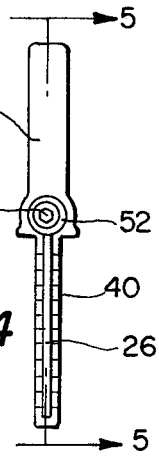
FIG. 4 is an end elevational view of the hanger.

Referring now to FIG. 5, the sleeve 30 is illustrated in detail, and as shown includes a body portion 40 in which a slot-like opening is formed that has a shape and configuration for receiving the outermost end of the arm 26. Formed as part of the sleeve 30 and extending upwardly from the body portion 40 is an extension 42 in which a window 44 is formed, the window 44 being suitable for receiving a label on which size and other identifying information may be imprinted. A gripping area 46 is located adjacent to the window 44 and provides a surface for gripping the sleeve 30 when it is to be moved in a longitudinal direction such as for mounting a pair of trousers on the hanger 24 as will be described hereinafter. Formed on the outermost end of the body portion 40 and located below the outer edge of the gripping area 46 is a serrated edge 48 that cooperates with the serrated edge 38 for gripping the waistband of a pair of trousers as will also be described.

The hanger 24 as embodied in the present invention is unique in that it is designed to retain a pair of trousers in a fully extended position that is suspended downwardly from the waistband as illustrated in FIG. 1. This is in contrast to the usual hanger, wherein the trousers are folded along the seams thereof and draped over a horizontal bar of the hanger, the waist band of the trousers normally being located substantially below the supporting bar and not being readily accessible for the inspection of the indentifying information thereon. In order to mount the trousers, a pair of which is indicated at 50 in FIG. 1, in a suspended position from the waistband, the waistband is placed over the serrated edges 38 and 48, and the sleeve 30 is then moved longitudinally in an outer direction, thereby forcing the serrated edges 38 and 48 of the sleeve 30 into positive engagement with the waistband. Thereafter, the sleeve 30 is locked in place to positively locate the trousers 50 in the extended and suspended position thereof. Referring again to FIG. 5, the lock element of the hanger 24 is illustrated and as shown the outer end of the body portion 40 of the sleeve 30 is provided with a bore 52 that communicates with an interior slot 54. A threaded bolt 56 is received in the slot 54 and is also located in threaded communication with a threaded portion 58 that is formed on the upper and outermost end of the arm 26. The outer end of the bolt 56 has a key slot 60 formed therein that receives a convenient tool such as an allen head wrench or the like, the end of the wrench being insertable into the bore 52 for engagement with the key slot 60. Thus, upon rotation of the bolt 56 in the appropriate direction, the sleeve 30 is moved in a corresponding longitudinal direction relative to the rack 10. With the waistband of the trousers 50 located over the serrated edges 38 and 48, the bolt 56 is rotated to move the sleeve 30 outwardly in the direction of the arrow to tension the waistband thereby locating the trousers 50 in an extended and suspended display position on the hanger 24.

It is seen that with the trousers 50 mounted in the extended and suspended display position, the full length of the trousers as mounted from the waistband is easily inspected, and the identifying information relative to the trousers may be easily seen by a customer. If it is desired to remove the trousers 50 from the hanger 24, the bolt 50 is rotated in the appropriate direction to longitudinally move the sleeve 30 inwardly, thereby releasing the waistband from the tensioned position thereof on the serrated edges 38 and 48. It is seen that the trousers are conveniently displayed in a suspended position on the hanger 24 and are mounted such that they may be visually inspected in a normal hanging position. The trousers are quickly mounted in place by movement of the sleeve in the outward direction, and if desired to remove the trousers from the extended display position, the sleeve is also easily moved inwardly by rotation of the bolt 56.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by scope of the appended claims.

What is claimed is:

1. A garment hanger for displaying trousers on a display rack, comprising an elongated arm having an inner and outer end portion, said inner end portion being mounted on said rack for locating said arm in cantilevered relation thereon, means on said inner and outer portions for mounting a pair of trousers for display at the waist thereon and in an extended and suspended position thereon, said means on said outer portion of said arm including a sleeve that is engageable by said garment, said sleeve having an interior slot formed therein that cooperates with an adjacent portion of said arm to define an interior bore, the adjacent portion of said aim having threads formed therein that communicate with said interior bore, a threaded bolt extending inwardly of said sleeve and into said interior bore for threaded engagement with the threaded portion of said arm and being captured in said bore for rotation relative to said sleeve, wherein rotation of said bolt produces a corresponding longitudinal movement of said sleeve, relative to said arm for expanding said trousers to the extended position thereof.

2. A hanger as claimed in claim 1, the inner end portion of said arm having a shoulder portion formed therein that is serrated, and the outermost end of said sleeve having a serrated portion that is spaced and generally parallel to the serrated shoulder portion, said trousers being mounted on said serrated shoulder portion and the serrated portion of said sleeve in the extended and suspended position thereof.

3. A hanger as claimed in claim 1, said sleeve having an outer end and said arm having a shoulder portion formed thereon adjacent to the inner portion thereof, said trousers being mounted on the outer end of said sleeve and said shoulder portion, said bolt being operable to move said sleeve outwardly with respect to said arm to tension said trousers in the extended position thereof on said sleeve outer end and shoulder portion.

4. A hanger as claimed in claim 3, said sleeve having an upstanding portion in which a slot is formed for receiving an indicating card therein.

5. A hanger as claimed in claim 3, said rack having a center member on which spaced discs are mounted, the inner end of said arm having a pin mounted thereon that is receivable in rotatable relation between the discs of said rack, wherein said arm is mounted on said center member in pivotal relation with respect thereto.

6. A garment rack for displaying trousers in tensioned relation thereon, comprising a center support member on which is mounted a hanger supporting assembly, said hanger supporting assembly including a central drum to which are secured spaced discs, a plurality of hanger arms pivotally mounted between said discs, each of said arms extending outwardly of said central drum and having an adjusting sleeve mounted for longitudinal movement on the outermost end thereof, a pair of trousers located on said arm and being retained in tensioned position thereon by said adjusting sleeve, the adjusting sleeve for each arm having an interior bore formed therein, and a threaded bolt extending into said bore and engaging a threaded portion of said arm that communicates with said bore, wherein rotation of said bolt produces a corresponding longitudinal movement of said sleeve relative to said arm for tensioning said garment in a suspended display position.

* * * * *